US006053766A

United States Patent [19]

Muramatsu et al.

[11] Patent Number: 6,053,766

[45] Date of Patent: Apr. 25, 2000

[54] LAMP SOCKET

[75] Inventors: Kenji Muramatsu; Takashi Ishii, both of Shizuoka, Japan

[73] Assignee: Yazaki Corporation, Tokyo, Japan

[21] Appl. No.: 09/112,009

[22] Filed: Jul. 8, 1998

[30] Foreign Application Priority Data

Jul. 10, 1997 [JP] Japan ..... 9-185415

[51] Int. Cl.[7] ..... H01R 13/73

[52] U.S. Cl. ..... 439/558; 439/569; 439/56; 439/357

[58] Field of Search ..... 439/558, 569, 439/56, 57, 557, 357, 358, 611, 617; 313/318.01–318.12, 49–51

[56] References Cited

U.S. PATENT DOCUMENTS

| | | | |
|---|---|---|---|
| 3,702,455 | 11/1972 | Raynor et al. | 439/558 |
| 3,790,923 | 2/1974 | Mathe | 439/557 |
| 3,894,205 | 7/1975 | List et al. | 439/558 |
| 4,647,132 | 3/1987 | Mikola | 439/167 |
| 5,073,742 | 12/1991 | Busai et al. | 313/318.01 |
| 5,226,834 | 7/1993 | Kato et al. | 439/358 |
| 5,320,539 | 6/1994 | Haskins | 439/558 |
| 5,378,168 | 1/1995 | Sumida | 439/357 |
| 5,380,208 | 1/1995 | Ying | 439/558 |

*Primary Examiner*—Paula Bradley
*Assistant Examiner*—Katrina Davis
*Attorney, Agent, or Firm*—Sughrue, Mion, Zinn, Macpeak & Seas, PLLC

[57] ABSTRACT

A lamp socket is disclosed. The lamp socket comprises a socket body engaged with a lamp, a cylindrical hood accommodating a light emitting portion of the lamp, the hood having a first end portion formed integrally with the lamp socket, and a second end portion forming a peripheral edge of an opening in which the lamp can be inserted therefrom, a flange provided on an outer peripheral face of the hood and abutting against a peripheral edge of a mounting hole in a panel, an elastic engaging portion disposed on the outer peripheral face of the hood and engaging with the peripheral edge of the mounting hole in the panel, and a protecting portion provided at both sides of the elastic engaging portion on the outer peripheral face of the hood and preventing the elastic engaging portion from deforming by external force.

10 Claims, 6 Drawing Sheets

LAMP SOCKET

BACKGROUND OF THE INVENTION

1. Field of the Invention

The present invention relates to a lamp socket for supporting a lamp illuminating the interior of a glove compartment of an automobile or the like.

2. Background of the Related Art

FIGS. 5 to 8 show a lamp socket 1 for supporting a glove compartment lamp 2 for illuminating the interior of a glove compartment of an automobile or the like. This lamp socket 1 includes a socket body 3 for fittingly receiving the lamp 2, a hood portion 5 which is molded integrally with the socket body 3, and is adapted to receive a light-emitting portion 4 of the lamp 2 therein, a flange portion 8 which is formed on an outer peripheral surface of the hood portion 5, and is adapted to be held against a peripheral edge portion of a mounting hole 7 formed through a panel 6 (see FIG. 8), and a pair of elastic engaging portions 9 each of which projects from the outer peripheral surface of the hood portion 5, and cooperates with the flange portion 8 to hold the peripheral edge portion of the mounting hole 7 in the panel 6 therebetween.

The flange portion 8 is in the form of a thin, annular disk formed on and projecting from the outer peripheral surface of the hood portion 5, and a pair of notches 10 are formed respectively in diametrically-opposite portions of the flange portion 8. Distal end portions of the elastic engaging portions 9 are fitted respectively in the notches 10. Each of the elastic engaging portions 9 includes an engaging arm 11 supported at one end thereof on the outer peripheral surface of the hood portion 5 (the other end thereof is a free end), and an engagement projection 12 which is formed at an intermediate portion of the engaging arm 11 so as to engage with the peripheral edge portion of the mounting hole 7 in the panel 6.

As shown in FIG. 7, the lamp (bulb) 2 is introduced into the hood portion 5, and is fitted into the socket body 3. In this condition, the light-emitting portion 4 of the lamp 2 is received in the hood portion 5. Terminals, connected to ends of wires (not shown), are received in the socket body 3, and when the lamp 2 is fitted into the socket body 3, a terminal portion of the lamp 2 is connected to the terminals connected to the wire ends. In this manner, the lamp 2 is attached to the lamp socket 1. The lamp sockets in this condition are transported and supplied, and in a production line, each lamp socket is mounted in the mounting hole 7 in the panel of a vehicle body.

When the lamp socket 1 is to be mounted in the mounting hole 7, the socket body 3 and the hood portion 5 are inserted through the mounting hole 7 from one side thereof, and the flange portion 8 is brought into abutting engagement with the peripheral edge portion of the mounting hole 7. At this time, each of the engagement projections 12 first abuts against the peripheral edge portion of the mounting hole 7, so that the engaging arm 11 is flexed, and then the engagement projection 12 passes through the mounting hole 7. When the engagement projection 12 thus passes through the mounting hole 7, the engagement projection 12 cooperates with the flange portion 8 to hold the peripheral edge portion of the mounting hole 7 therebetween because of the elasticity of the engaging arm 11. Thus, the lamp socket 1 is mounted in the mounting hole 7 in the panel 6.

In the above lamp socket 1, however, each of the engaging arms 11 is formed into such a small thickness that it can have elasticity, and therefore when an external force (e.g. an impact force produced when the lamp socket drops) is applied to the engaging arm 11, there is a possibility that the engaging arm is damaged or broken.

And besides, since the flange 8 has a small thickness, there is encountered a problem that those thin portions of the flange 8 in the vicinities of the notches 10 are liable to be damaged upon application of an external force (e.g. an impact force produced at the time of dropping of the lamp socket).

SUMMARY OF THE INVENTION

It is therefore an object of the present invention to provide a lamp socket in which thin portions thereof will not be broken even when an external force is applied thereto.

In order to achieve the above object, according to the invention, there is provided a lamp socket comprising a socket body engaged with a lamp, a cylindrical hood accommodating a light emitting portion of the lamp, the hood having a first end portion molded integrally with the lamp socket, and a second end portion forming a peripheral edge of an opening in which the lamp can be inserted therefrom, a flange provided on an outer peripheral face of the hood and abutting against a peripheral edge of a mounting hole in a panel, an elastic engaging portion disposed on the outer peripheral face of the hood and engaging with the peripheral edge of the mounting hole in the panel, and a protecting portion provided at both sides of the elastic engaging portion on the outer peripheral face of the hood and preventing the elastic engaging portion from deforming by external force.

In this lamp socket, even when an external force is applied to the elastic engaging portion, the elastic engaging portion is protected by the protecting portion, and is prevented from deformation, and therefore the thin portions will not be damaged or broken even upon application of the external force.

According to the present invention, the peripheral edge of the opening includes a thinned edge portion and a thickened edge portion, and the thinned edge portion is positioned closer to the socket body than the thickened edge portion.

In this lamp socket, when an external force (e.g. an impact force produced at the time of dropping of the lamp socket) is applied, the impact force is applied to the thickened edge portion, and will not act directly on the thinned edge portion. Therefore, in the lamp socket of the present invention, the thin edge portions will not be damaged even upon application of the external force.

According to the present invention, the elastic engaging portion includes an elastic support portion in which one end thereof is supported by the first end portion of the hood and the other end thereof is supported by the second end portion of the hood, and a engaging projection provided on an intermediate portion of the elastic engaging portion and cooperating with the flange to hold the peripheral edge of the mounting hole in the panel therebetween, and the protecting portion is a pair of wall portions disposed at both sides of at least that portion of the elastic engaging portion closer to the first end portion of the hood portion than the engaging projection.

In this lamp socket, even if an impact force is applied to the elastic engaging portion as at the time of dropping of the lamp socket, this impact force is applied to the pair of wall portions provided respectively at both sides of the elastic engaging portion, and will not act directly on the elastic engaging portion.

According to the present invention, the wall portions are respectively connected integrally with the flange.

In this lamp socket, the wall portions protect the elastic engaging portion, and also enhances the strength of the flange.

According to the present invention, the protection portion further includes a connecting wall interconnecting the pair of wall portions and covering outside of the elastic engaging portion.

In this lamp socket, since the pair of wall portions are interconnected by the connecting wall, the strength of the pair of wall portions, capable of withstanding an external force, is enhanced, and the elastic engaging portion can be protected more positively.

According to the present invention, the end portion of the elastic support portion in the side of the second end portion of the hood is supported by the thickened portion of the second end portion of the hood.

In this lamp socket, since the elastic support portion is supported at one end on the thickened edge portion of the hood, an external force will not act directly on the one end of the elastic support portion, but will act on the thickened edge portion, and therefore the elastic support portion will not be damaged by the external force.

DETAILED DESCRIPTION OF THE PREFERRED EMBODIMENT

Figure 1:
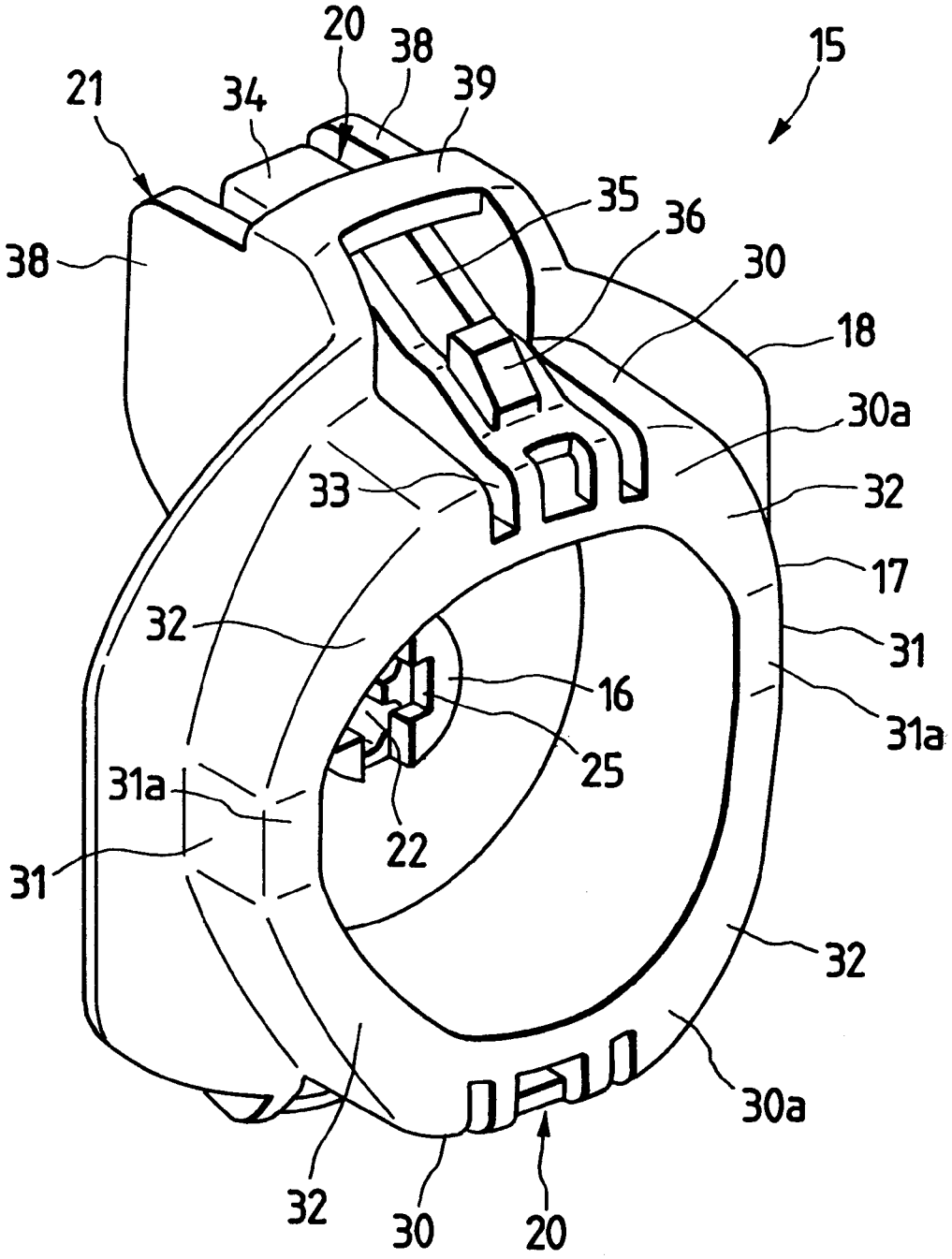
FIG. 1 is a perspective view of one preferred embodiment of a lamp socket of the present invention.
Figure 2:
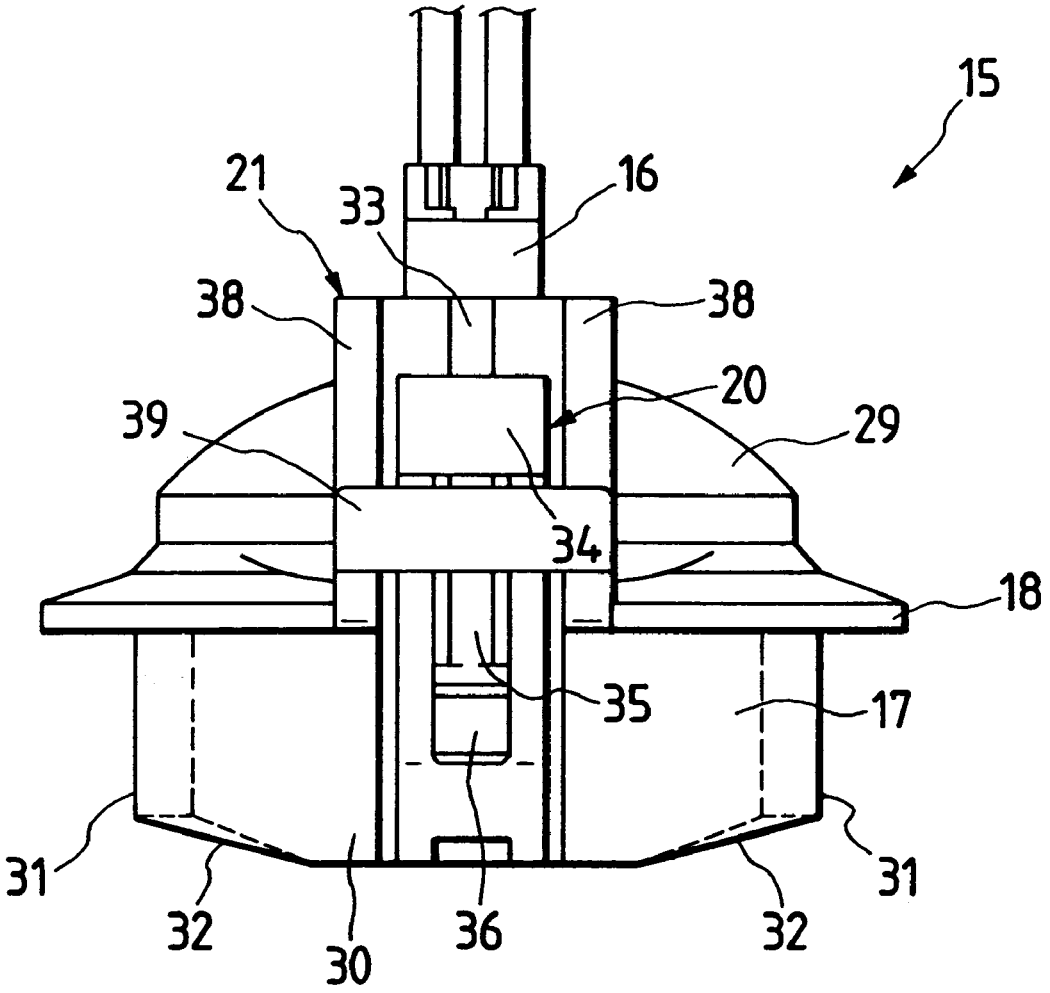
FIG. 2 is a side-elevational view of the lamp socket of the embodiment.
Figure 3:
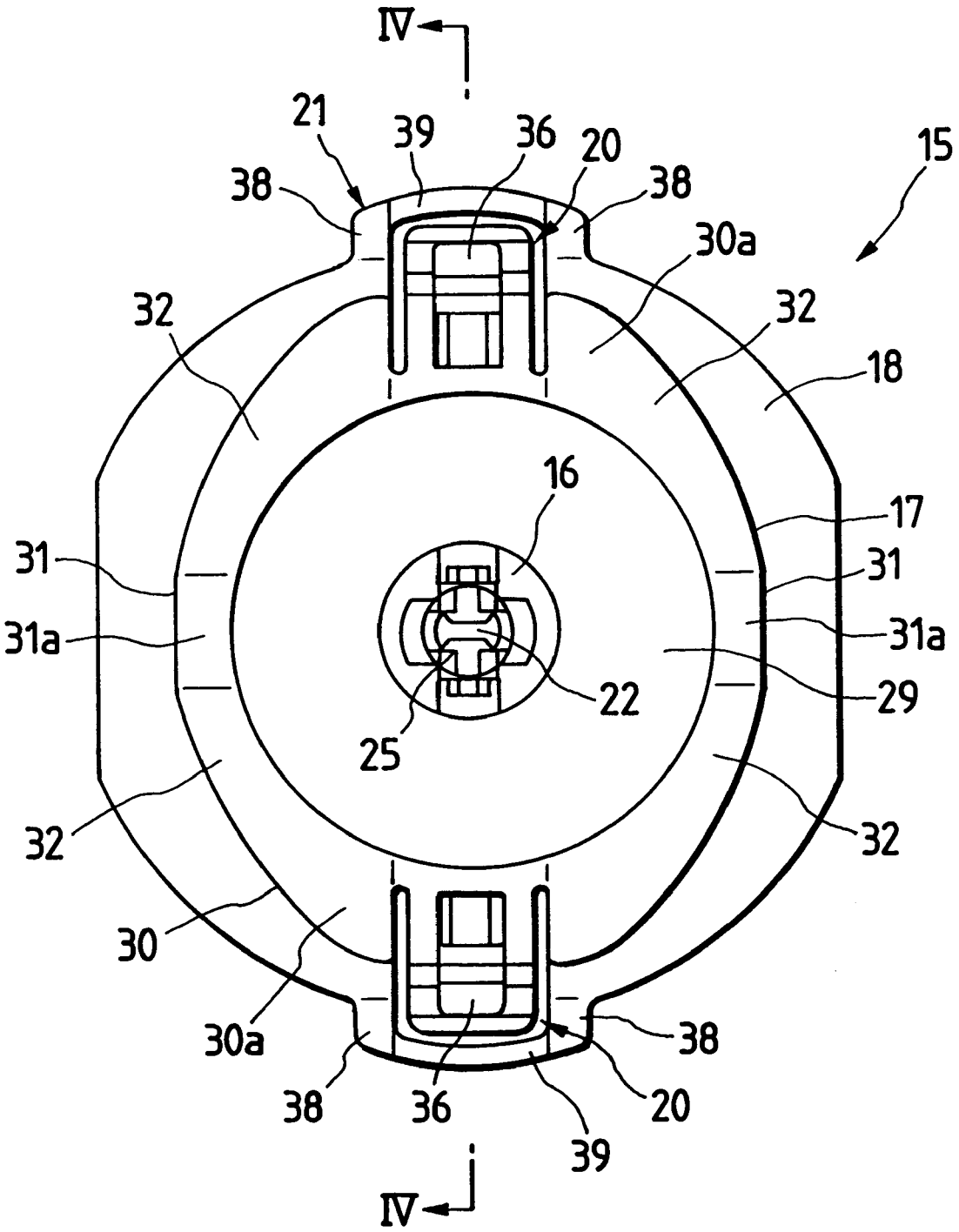
FIG. 3 is a front-elevational view of the lamp socket of the embodiment.
Figure 4:
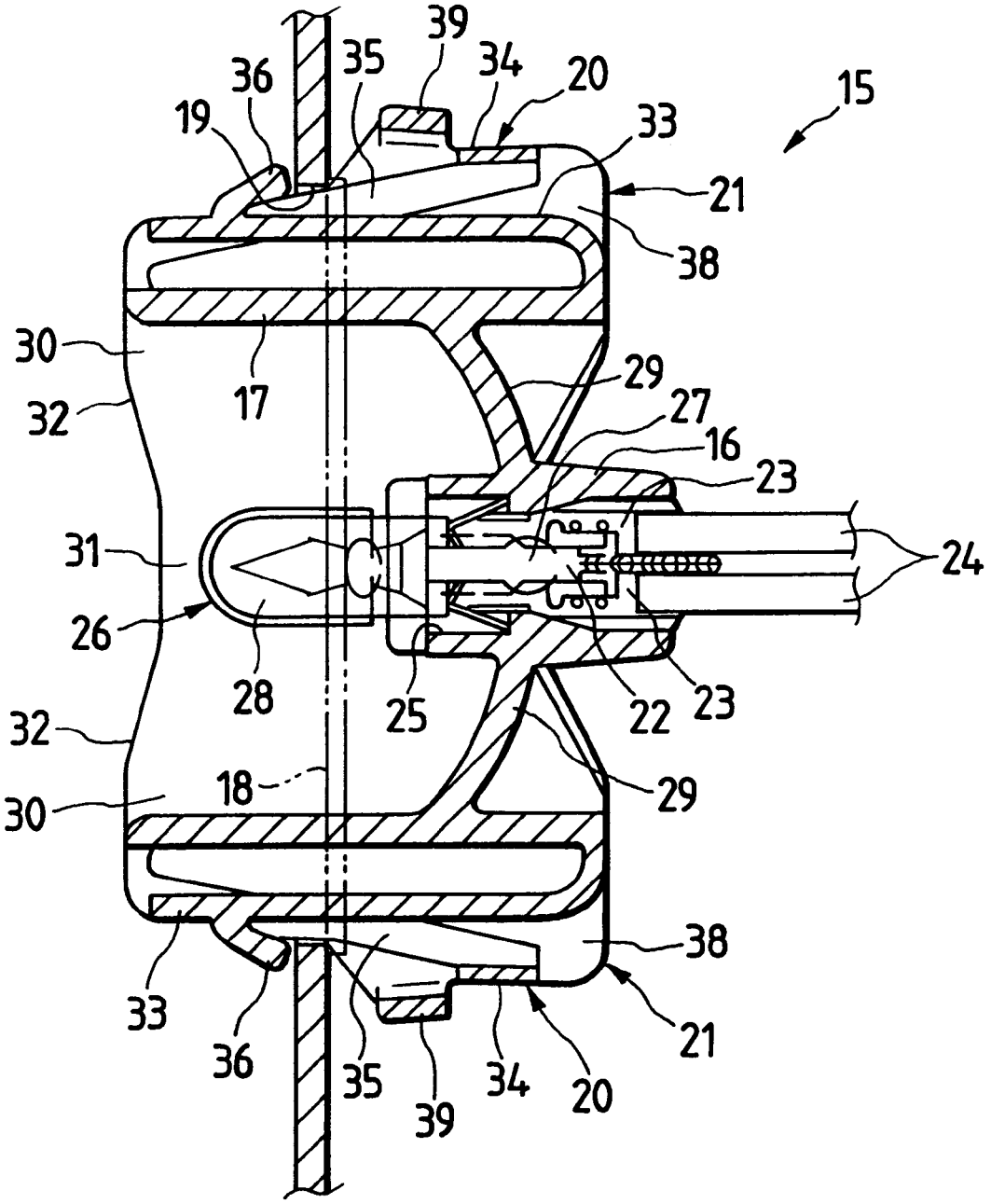
FIG. 4 is a cross-sectional view showing the internal structure of the lamp socket of the embodiment.
Figure 5:
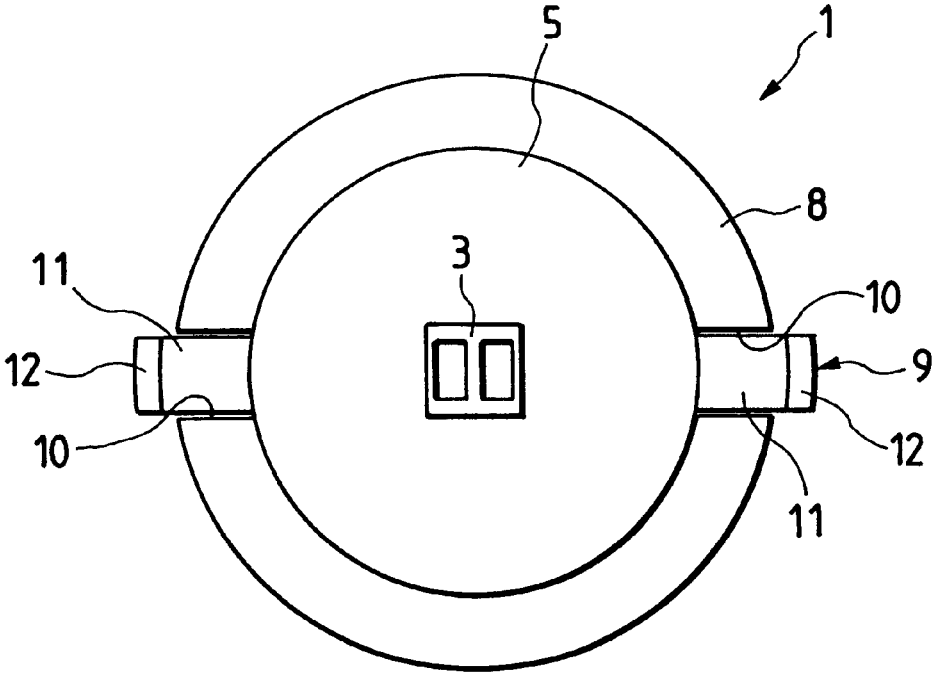
FIG. 5 is a plan view showing a conventional lamp socket.
Figure 6:
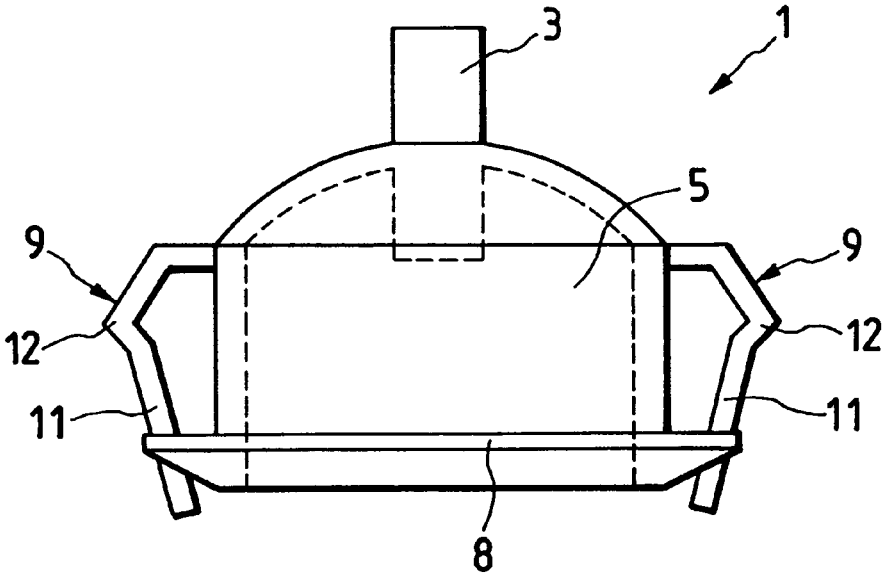
FIG. 6 is a side-elevational view of the conventional lamp socket.
Figure 7:
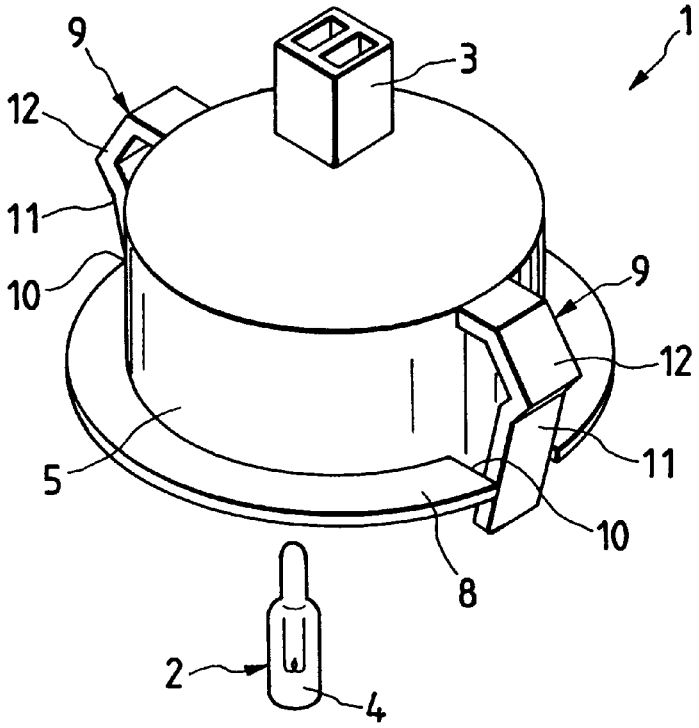
FIG. 7 is a perspective view showing the conventional lamp socket and a lamp.
Figure 8:
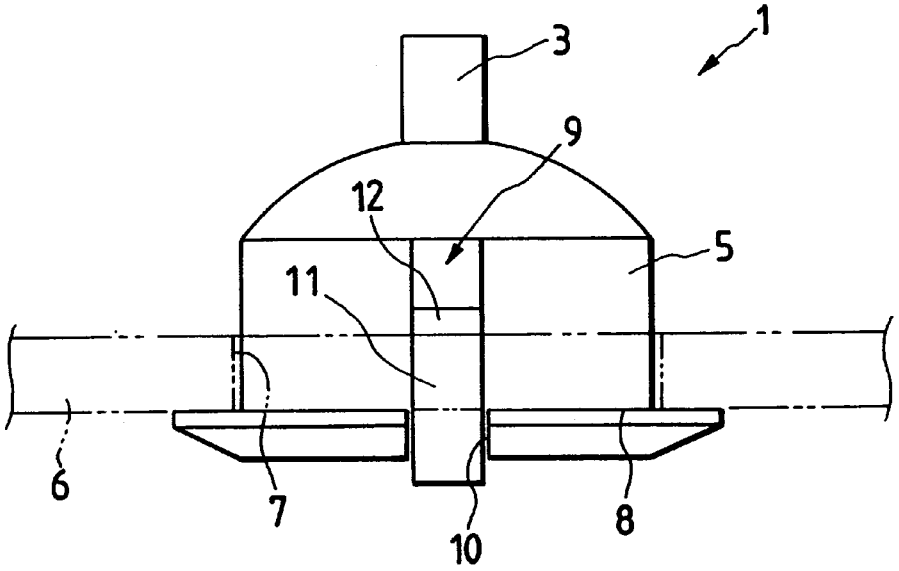
FIG. 8 is a side-elevational view the conventional lamp socket mounted in a mounting hole in a panel.

A preferred embodiment of a lamp socket of the present invention will now be described. FIG. 1 is a perspective view of a lamp socket 15, FIG. 2 is a side-elevational view thereof, and FIG. 3 is a front-elevational view thereof. FIG. 4 is a cross-sectional view showing the internal structure of the lamp socket 15.

As shown in FIGS. 1 to 3, the lamp socket 15 includes a socket body 16, a hood portion 17 molded integrally with the socket body 16, a flange portion 18 formed on an outer peripheral surface of the hood portion 17, and elastic engaging portions 20 each of which cooperates with the flange portion 18 to hold a peripheral edge portion of a mounting hole 19 in a panel therebetween. In this embodiment, a deformation prevention rib 21 for preventing the deformation of the elastic engaging portion 20 by an external force is provided integrally at both sides of each of the elastic engaging portions 20. End surfaces 31*a* of thinned portions of the hood portion 17 are offset toward the socket body 16 relative to end surfaces 30*a* of thickened portions 30. That portion of the end surface of the hood portion 17, extending between any adjacent thinned portion 31 and thickened portion 30, is tapered as at 32.

As shown in FIG. 4, a terminal receiving portion 22, having opposite open ends, is provided in the socket body 16. Terminals 23 are received in the terminal receiving portion 22, and wires 24, connected respectively to the terminals 23, extend outwardly from one open end of the terminal receiving portion 22. The other open end portion serves as a lamp fitting portion 25. A terminal portion 27 of a lamp 26 is inserted and fitted in the lamp fitting portion 25, and is connected to the terminals 23. A curved support portion 29 is formed on and extends from the outer peripheral surface of the socket body 16, and the hood portion 17 is formed integrally with the curved support portion 29.

The hood portion 17 has the thickened portions 30 which are disposed respectively at the same positions as those of the elastic engaging portions 20 in the peripheral direction, and the thinned portions 31 are formed between the thickened portions 30. The end surfaces 31*a* of the thinned portions 31 are offset toward the socket body 16 relative to the end surfaces 30*a* of the thickened portions 30, and that portion of the end surface of the hood portion 17, extending between any adjacent thinned portion 31 and thickened portion 30, is tapered as at 32. A light-emitting portion 28 (see FIG. 4) of the lamp 26, fitted in the socket body 16, is received within the hood portion 17. The thin flange portion 18 is formed on and projects from that portion of the outer peripheral surface of the hood portion 17 disposed close to the socket body 16.

Those portions of the flange 18, disposed respectively at the thickened portions 30 of the hood portion 17, have an arcuate outer shape, and those portions of the flange 18, disposed respectively at the thinned portions 31, have a linear outer shape. The flange 18 abuts against the peripheral edge portion of the mounting hole 19 in the panel, and cooperates with a engaging projection 36 of each of the elastic engaging portion 20 to hold this peripheral edge portion therebetween.

The elastic engaging portions 20 are provided respectively at the thickened portions 30 of the hood portion 17, and each elastic engaging portion 20 cooperates with the flange portion 18 to hold the peripheral edge portion of the mounting hole 19 in the panel therebetween, thereby mounting the lamp socket 15 on the panel. The elastic engaging portion 20 includes an elastic support portion 33, which is supported at one end on that portion of the hood portion 17 close to the thickened portion 30, and is supported at the other end on that portion of the hood portion 17 close to the curved support portion 29, and a release arm 35 which is connected at one end to that portion of the elastic support portion 33 close to the thickened portion 30, and has a release operating portion 34 formed at the other end (free end) thereof. The engaging projection 36 is formed on the elastic engaging portion 20. The deformation prevention rib 21 is provided integrally on the opposite sides of the elastic engaging portion 20.

The deformation prevention rib 21 comprises a pair of wall portions 38 which are provided respectively on opposite sides of that portion of the elastic engaging portion 20 close to the socket body 16 and also respectively on opposite sides of that portion of the release arm 35 close to the socket body 16. The pair of wall portions 38 and 38 are interconnected by a connecting wall 39. The elastic engaging portion 20 is covered by the pair of wall portions 38, and therefore when an external force (e.g. an impact force produced at the time of dropping of the lamp socket) is applied to this portion, this external force is applied to the pair of wall portions 38, and will not act directly on the elastic engaging portion 20.

The lamp 26 is attached to the socket body 16, and in this condition the lamp socket is supplied, and is mounted in the mounting hole 19 in the panel of the vehicle body. In this mounting operation, when the distal end of the hood portion 17 is inserted through the mounting hole 19, the engaging projections 36 abut against the peripheral edge portion of the mounting hole 19, and when the hood portion 17 is further passed through the mounting hole 19, each elastic support portion 33 is flexed to move the engaging projection 36 toward the hood portion 17. When each engaging projection 36 passes past the peripheral edge portion of the mounting hole 19, the engaging projection 36 is returned to its initial position because of the elasticity of the elastic support portion 33. In this condition, the flange portion 18 is held against the peripheral edge portion of the mounting hole 19, and cooperates with each engaging projection 36 to hold the peripheral edge portion of the mounting hole 19 therebetween. Thus, the lamp socket 15 is mounted in the mounting hole 19 in the panel.

Even if the lamp socket 15 accidentally drops during this operation or during the supply of this lamp socket, the thin portions (e.g. the elastic engaging portions 20 and the thinned portions 31 of the hood portion 17) of the lamp socket 15 of this embodiment will not be damaged or broken.

Namely, in the lamp socket 15 of this embodiment, each elastic engaging portion 20 is protected by the deformation prevention rib 21 comprising the pair of wall portions 38, and therefore an impact force, produced upon dropping of the lamp socket, is applied to the pair of wall portions 38, and will not act directly on the elastic engaging portion 20. Therefore, damage to the elastic engaging portion 20 is positively prevented.

In the lamp socket 15 of this embodiment, the thinned portions 31 of the hood portion 17 are offset toward the socket body 16 relative to the end surfaces of the thickened portions 30, and therefore when the lamp socket drops, the thickened portions 30 first strike against the floor, and an impact force is applied to the thickened portions 30, so that the thinned portions 31 can be protected.

In the lamp socket 15 of this embodiment, each elastic engaging portion 20 is protected by the deformation prevention rib 21, and the thinned portions 31 are offset out of the plane of the end surfaces 30*a* of the thickened portions 30, and therefore even if an external force is applied to the lamp socket, the thinned portions 31 will not be damaged or broken.

As described above, according to the present invention, even when an external force is applied to the elastic engaging portion, the elastic engaging portion is protected by the deformation prevention rib, and is prevented from deformation, and therefore the thin portions will not be damaged or broken.

According to the present invention, the end surfaces of the thinned portions of the hood portion are offset toward the socket body relative to the end surfaces of the thickened portions of the hood portion, and with this construction when an external force (e.g. an impact force produced at the time of dropping of the lamp socket) is applied, the impact force is applied to the thickened portion, and will not act directly on the thinned portion. Therefore, in the lamp socket of the present invention, the thin portions will not be damaged even upon application of an external force.

According to the present invention, when an impact force is applied as a result of dropping of the lamp socket, this impact force is applied to the thickened portion, and will not act directly on the thinned portion, and therefore the thin portions will not be damaged even upon application of an external force.

According to the present invention, even if an impact force is applied to the elastic engaging portion as at the time of dropping of the lamp socket, this impact force is applied to the pair of wall portions provided respectively on the opposite sides of the release arm, and will not act directly on the elastic engaging portion, and therefore the elastic engaging portion can be positively protected.

According to the present invention, the pair of wall portions are interconnected by the connecting wall, and therefore the strength of the pair of wall portions, capable of withstanding an external force, is enhanced, and the elastic engaging portion can be protected more positively.

According to the present invention, the elastic support portion is supported at one end on the thickened portion of the hood portion, and therefore an external force will not act directly on the one end of the elastic support portion, but will act on the thickened portion, and therefore the elastic support portion will not be damaged by an external force.

What is claimed is:

1. A lamp socket comprising:

a socket body engaged with a lamp;

a cylindrical hood accommodating a light emitting portion of the lamp, the hood having a first end portion molded integrally with the lamp socket, and a second end portion forming a peripheral edge of an opening in which the lamp can be inserted therefrom;

a flange provided on an outer peripheral face of the hood and abutting against a peripheral edge of a mounting hole on a panel;

an elastic engaging portion disposed on the outer peripheral face of the hood and engaging with the peripheral edge of the mounting hole in the panel; and a protecting portion provided at both sides of the elastic engaging portion on the outer peripheral face of the hood and preventing the elastic engaging portion from deforming by external force, said protecting portion including a wall extending along a substantial length of said elastic engaging portion.

2. The lamp socket as set forth in claim 1, wherein the peripheral edge of the opening includes a thinned edge portion and a thickened edge portion, and wherein the thinned edge portion is positioned closer to the socket body than the thickened edge portion.

3. The lamp socket as set forth in claim 2, wherein the elastic engaging portion includes an elastic support portion in which one end thereof is supported by the first end portion of the hood and the other end thereof is supported by the second end portion of the hood, and an engaging projection provided on an intermediate portion of the elastic engaging portion and cooperating with the flange to hold the peripheral edge of the mounting hole in the panel therebetween, and wherein the protecting portion is a pair of wall portions disposed at both sides of at least that portion of the elastic engaging portion closer to the first end portion of the hood portion than the engaging projection.

4. The lamp socket as set forth in claim 3, wherein the wall portions are respectively connected integrally with the flange.

5. The lamp socket as set forth in claim 3, wherein the protection portion further includes a connecting wall interconnecting the pair of wall portions and covering outside of the elastic engaging portion.

6. The lamp socket as set forth in claim 3, wherein the end portion of the elastic support portion in the side of the second end portion of the hood is supported by the thickened portion of the second end portion of the hood.

7. A lamp socket comprising:

a socket body engaged with a lamp;

a cylindrical hood accommodating a light emitting portion of the lamp, the hood having a first end portion molded integrally with the lamp socket, and a second end portion forming a peripheral edge of an opening in which the lamp can be inserted therefrom;

a flange provided on an outer peripheral face of the hood and abutting against a peripheral edge of a mounting hole on a panel;

an elastic engaging portion disposed on the outer peripheral face of the hood and engaging with the peripheral edge of the mounting hole in the panel; and a protecting portion provided at both sides of the elastic engaging portion on the outer peripheral face of the hood and preventing the elastic engaging portion from deforming by external force, wherein the elastic engaging portion includes an elastic support portion in which one end thereof is supported by the first end portion of the hood and the other end thereof is supported by the second end portion of the hood, and an engaging projection provided on an intermediate portion of the elastic engaging portion and cooperating with the flange to hold the peripheral edge of the mounting hole in the panel therebetween, and wherein the protecting portion is a pair of wall portions disposed at both sides of at least that portion of the elastic engaging portion closer to the first end portion of the hood portion than the engaging projection.

8. The lamp socket as set forth in claim 7, wherein the wall portions are respectively connected integrally with the flange.

9. The lamp socket as set forth in claim 7, wherein the protection portion further includes a connecting wall interconnecting the pair of wall portions and covering outside of the elastic engaging portion.

10. The lamp socket as set forth in claim 7, wherein the end portion of the elastic support portion in the side of the second end portion of the hood is supported by the thickened portion of the second end portion of the hood.

* * * * *